US005100128A

United States Patent [19]

Mabry et al.

[11] Patent Number: 5,100,128

[45] Date of Patent: Mar. 31, 1992

[54] EXERCISE DEVICE FOR WHEELCHAIR OCCUPANTS

[76] Inventors: George D. Mabry, P.O. Box 6469, Jackson, Miss. 39282; Paul H. Pettie, 490 Julienne St., C-2, Jackson, Miss. 39201

[21] Appl. No.: 631,095

[22] Filed: Dec. 19, 1990

[51] Int. Cl.[5] ..... A63R 21/00

[52] U.S. Cl. ..... 482/134; 482/137; 482/139; 482/98

[58] Field of Search ..... 272/117, 118, 134, 123, 272/72, DIG. 4, 143

[56] References Cited

U.S. PATENT DOCUMENTS

| | | | |
|---|---|---|---|
| 3,116,062 | 12/1963 | Zinkin | 272/118 |
| 4,344,617 | 8/1982 | Szabo | 272/117 |
| 4,765,614 | 8/1988 | Shute | 272/130 |
| 4,880,227 | 11/1989 | Sowell | 272/134 |
| 4,907,798 | 3/1990 | Burchatz | 272/134 |
| 4,911,435 | 3/1990 | Johns | 272/134 |

FOREIGN PATENT DOCUMENTS

| | | | |
|---|---|---|---|
| 2833354 | 2/1980 | Fed. Rep. of Germany | 272/DIG. 4 |

*Primary Examiner*—Richard J. Apley
*Assistant Examiner*—Jerome Donolly
*Attorney, Agent, or Firm*—Fleit, Jacobson, Cohn, Price, Holman & Stern

[57] ABSTRACT

Exercise equipment for use by wheelchair occupants to enable exercise of muscle groups located in the upper torso that are used in lifting or transferring loads and incorporating various options with respect to weight stacks and pivotal linkage arrangements to enable a wheelchair occupant to use a single hand or both hands when exercising. The exercise device includes structure which enables the wheelchair and the occupant to be securely anchored in relation to a generally vertically disposed, laterally open frame which enables the wheelchair and occupant to enter the frame when facing in either direction.

9 Claims, 3 Drawing Sheets

EXERCISE DEVICE FOR WHEELCHAIR OCCUPANTS

BACKGROUND OF THE INVENTION

1. Field of the Invention

The present invention generally relates to exercise equipment for use by wheelchair occupants to enable exercise of muscle groups located in the upper torso that are used in lifting or transferring loads and incorporating various options with respect to weight stacks and pivotal linkage arrangements to enable a wheelchair occupant to use a single hand or both hands when exercising. The exercise device includes structure which enables the wheelchair and the occupant to be securely anchored in relation to a generally vertically disposed, laterally open frame which enables the wheelchair and occupant to enter the frame when facing in either direction.

2. Information Disclosure Statement

Our prior U.S. Pat. No. 4,747,595, issued May 31, 1988 for EXERCISER FOR WHEELCHAIR OCCUPANTS, discloses a frame structure which is provided with a lateral open side to enable a wheelchair to enter the frame together with weight and pulley arrangements and structure to secure the wheelchair and occupant in predetermined relation to the frame. This patent and the prior art of record therein are incorporated herein by reference thereto. However, the prior art does not disclose the specific structure of the exercise device of this invention with the major differences being in the frame construction, the arrangement of the weight stacks and the pivotal linkage including a handle structure by which the weight stacks can be raised and lowered for exercise purposes together with a unique structure for retaining the wheelchair and the wheelchair occupant securely retained in relation to the exercise device.

SUMMARY OF THE INVENTION

An object of the present invention is to provide an exercise device for use by wheelchair occupants which can be used in substantially any location which includes a generally U-shaped frame that extends vertically from a support surface with one side of the frame being open to enable a wheelchair to enter the frame when facing in a forward direction or a rearward direction with a unique structure being provided to secure the wheelchair in secure relation to the frame and to secure the occupant of the wheelchair securely in the wheelchair to enable various exercise regimens to be followed by the wheelchair occupant.

Another object of the invention is to provide an exercise device in which the frame is provided with a weight stack arrangement and a handle structure pivotally supported from the frame and including a linkage connected to the weight stack for raising and lowering a predetermined weight by manipulation of the handle structure.

A further object of the invention is to provide an exercise device in accordance with the preceding objects in which the handle can be adjusted to optimum relation to the wheelchair occupant and the linkage is adjustable to vary the fulcrum points and forces required to raise a predetermined weight with the number of weights connected to the linkage being varied thereby enabling various exercise regimens to be followed.

Still another object of the invention is to provide an exercise device in accordance with the preceding objects which is durable and long-lasting, effective to enable various muscle groups to be exercised, easy to be used by a wheelchair occupant without assistance and capable of being constructed with various options to enhance the utility thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
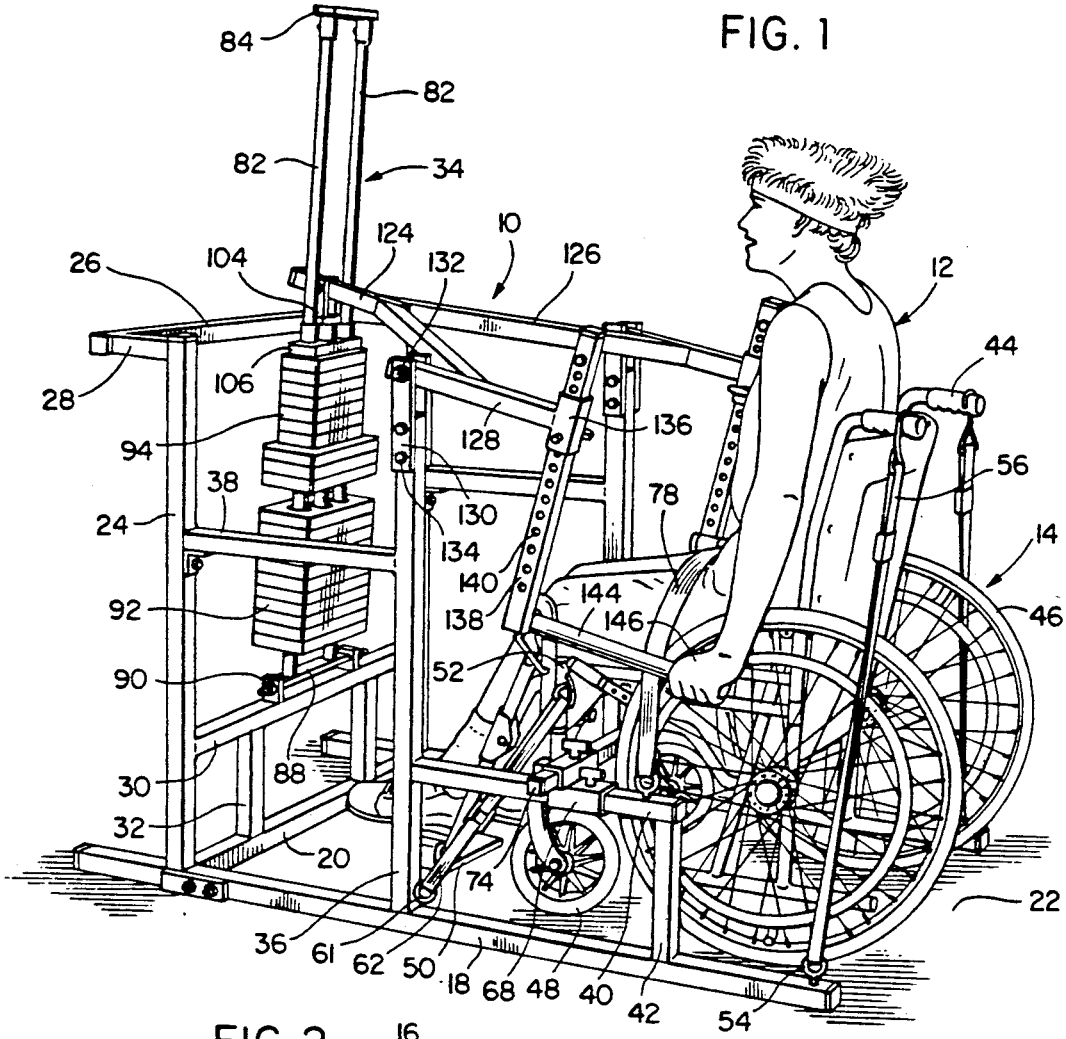
FIG. 1 is a perspective view of the exercise device of the present invention illustrating the association of a wheelchair and wheelchair occupant with the device.

Referring now specifically to FIGS. 1-5 of the drawings, the exercise device of the present invention is generally designated by reference numeral 10 which can be used by an occupant 12 of a conventional wheelchair 14 with the exercise device 10 receiving the wheelchair and occupant when in a forwardly facing direction as illustrated in FIG. 1 or in a reverse direction thereby enabling various torso muscle groups to be effectively exercised.

The exercise device includes a frame 16 which, in plan, is generally U-shaped in configuration and constructed of a plurality of tubular frame members of adequate strength and size which are of conventional metal construction and which can be secured together by welding or detachable joints to enable the device to be transported when in a knockdown position. The frame 16 includes a pair of laterally spaced, parallel bottom side frame members 18. Adjacent to one end of the frame members 18, a transversely extending bottom end frame member 20 interconnects the bottom side frame members 18 with the frame member 20 being spaced from the terminal ends of the frame members 18. The other ends of the bottom side frame members 18 are not connected thus leaving an open space 22 to enable the wheelchair 14 to roll into the frame 16 toward the bottom end frame member 20 to a position illustrated in FIG. 1.

Extending upwardly from each of the bottom side frame members 18 in alignment with the end frame member 20 is a pair of front vertical frame members 24 which are parallel to each other and in alignment with the bottom side frame members 18. The upper ends of the front vertical frame members 24 are interconnected by an upper end frame member 26 which is spaced forwardly from the upper end of the vertical frame members 24 by short upper side frame members 28 which have a length generally equal to the length of the end portions of the bottom side frame members 18 which extend beyond the vertical frame members 24.

Parallel to and spaced above the bottom end frame member 20 is an intermediate end frame member 30 which is rigidly interconnected with the vertical frame members 24 and spaced in parallel relation above the bottom end frame member 20. A pair of vertical spacer frame members 32 extend between the bottom end frame member 20 and the intermediate end frame member 30 to rigidly maintain the end frame members 20 and 30 in parallel relation. The intermediate end frame member 30 supports a weight stack assembly generally designated by reference numeral 34 which extends above the upper end of the frame and associated with the intermediate end frame member 30 in a manner described hereinafter.

Figure 3:
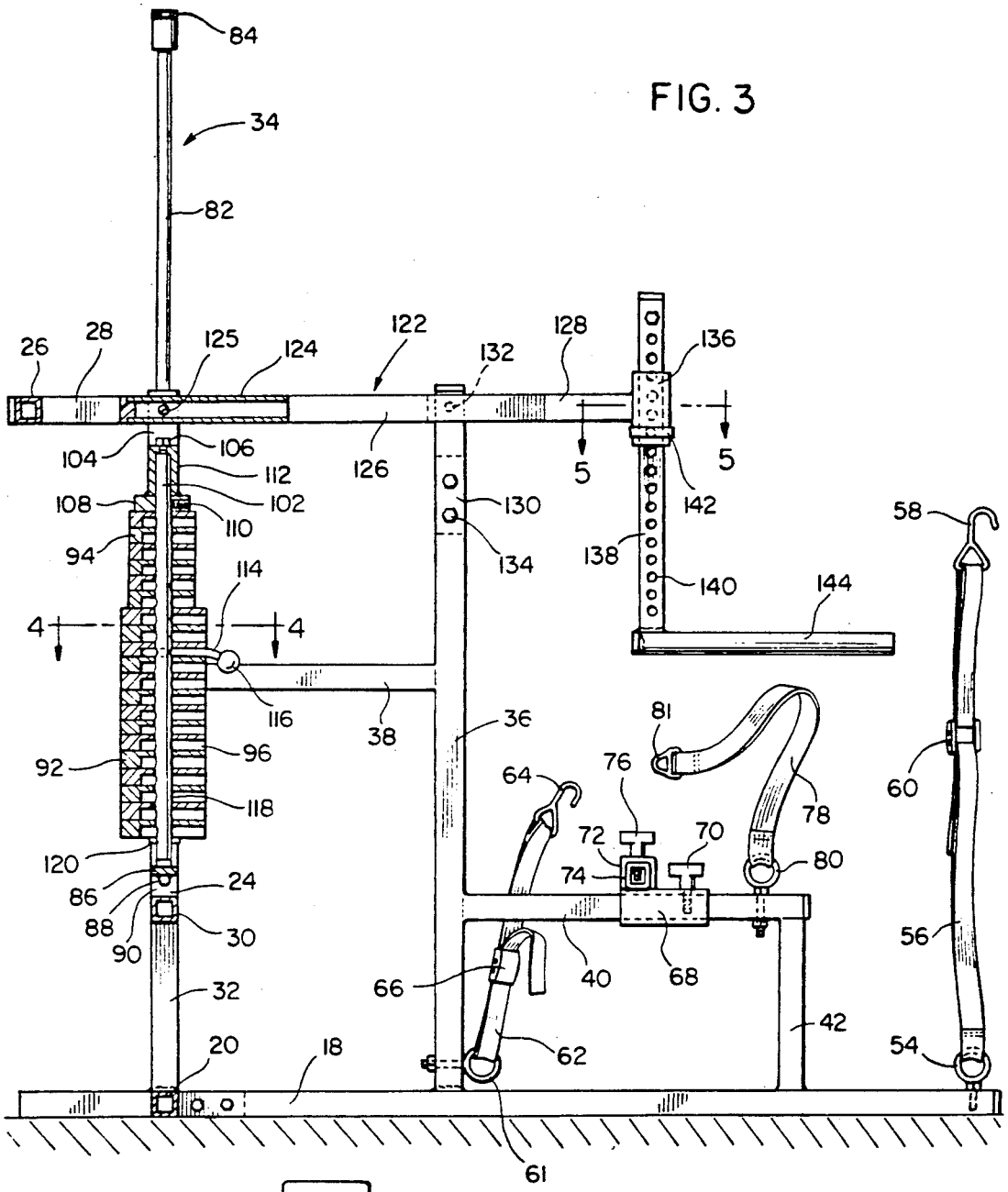
FIG. 3 is a vertical, sectional view taken substantially upon a plane passing along section line 3—3 on FIG. 2 illustrating specific structural details of the exercise device.
Figure 4:
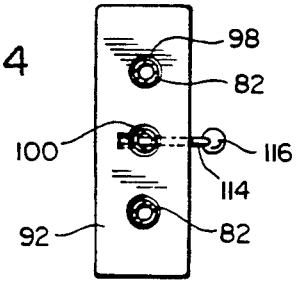
FIG. 4 is a sectional view taken substantially upon a plane passing along section line 4—4 on FIG. 3 illustrating structural details of the weight stack.
Figure 5:
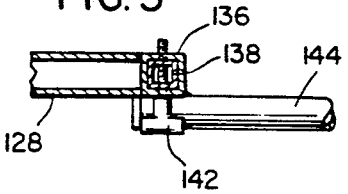
FIG. 5 is a sectional view taken substantially upon a plane passing along section line 5—5 on FIG. 3 illustrating specific structural details of the adjustable handle and linkage structure.

An intermediate vertical frame member 36 extends upwardly from and is rigid in association with the central portion of the bottom side frame member 18 with the two vertical frame members 36 being disposed in parallel relation to the front vertical frame members 24 and being slightly shorter than the vertical frame members 24 as illustrated in FIGS. 1 and 3. Each of the front vertical frame members 24 and the intermediate vertical frame members 36 are interconnected by an upper forward side frame member 38 thus forming a rigid frame structure at each side of the frame 16.

Figure 2:
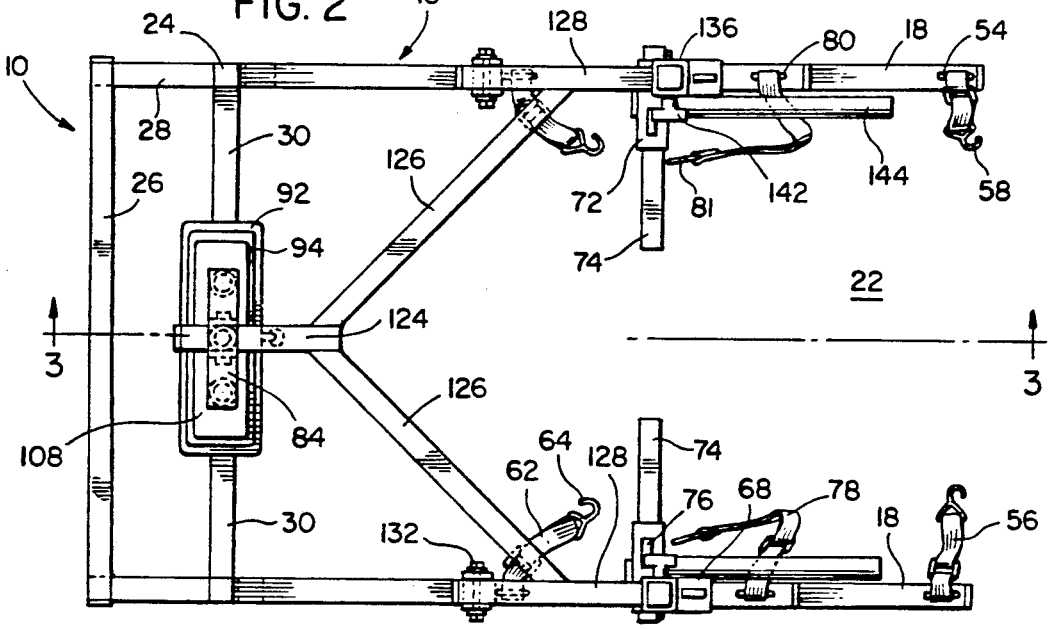
FIG. 2 is a top plan view of the exercise device.

Extending rearwardly from each of the intermediate vertical frame members 36 is an upper rear side frame member 40 in spaced parallel relation to the bottom side frame member 18 and which is located at a vertical height substantially below the upper forward side frame members 38 as illustrated in FIGS. 1 and 3. The rearward end of the rear side frame member 40 is supported by a rear vertical frame member 42 which has a vertical length substantially less than the vertical frame members 24 and 36. All of the vertical frame members 24, 36 and 42 are in the same vertical plane and all of the side frame members 18, 38 and 40 are in the same plane thus defining the two sides of the frame 16 which are interconnected by the end frame members 20, 26 and 30, thus, defining a generally rectangular frame of U-shaped plan configuration as illustrated in FIG. 2.

The wheelchair 14 is of conventional construction and includes a pair of handles 44 at the rear thereof, a pair of large wheels 46 and a pair of smaller front caster wheels 48, forward foot supports 50 and a forward frame structure 52. The rearward end of each of the bottom side frame members 18 is provided with an eye bolt 54 projecting from the upper surface thereof to which is attached an adjustable anchor strap 56 having a hook 58 on the upper end thereof for engagement with one of the handles 44. An adjustment buckle 60 is provided to adjust the effective length of the flexible strap 56 in order to tie down or anchor the rearward portion of the wheelchair frame to the frame 16 by connecting the adjustable straps 56 to the handles 44 with the straps extending downwardly and outwardly in a diverging relationship to retain the rearward portion of the wheelchair anchored to the rearward portion of the frame 16. The forward frame portion 52 of the wheelchair 14 is anchored to an eye bolt 61 attached to the lower end of each of the intermediate vertical frame members 36 with the loop or eye of the bolt extending rearwardly from the rearwardly facing surface thereof as illustrated in FIGS. 1 and 3. A flexible tie down strap 62 is connected to the eye bolt 61 and includes a hook 64 at its upper end for engagement with an aperture in the forward frame portion 52 of the wheelchair. A buckle structure 66 is provided in the strap 62 to adjust the length thereof with the straps 62 extending downwardly, outwardly and forwardly to retain the forward portion of the wheelchair anchored in relation to the frame 16.

Mounted on each of the upper rear side frame members 40 is a tubular sleeve 68 secured slidably in adjusted position thereon by a clamp bolt structure 70. The sleeve 68 has a transversely extending sleeve 72 rigid therewith which slidably supports a stop member 74 therein with the stop member 74 extending laterally inwardly a sufficient distance to be engaged by the forward portion of one of the large wheels 46 as illustrated in FIG. 1. A clamp bolt or screw 76 secures the stop member 74 in laterally adjusted position. Once the forward frame portion 52 of the wheelchair passes the stop member 74, they can be loosened and adjusted inwardly into the path of movement of the large wheels 46 and locked in position by the clamp screw 76. The longitudinal position of the stop member 74 can be adjusted by operating the clamp screw or bolt 70 and sliding the sleeve 68 on the upper rear side frame member 40. With the stop members 74 in adjusted and locked position, the wheelchair is rolled forwardly until the forward surface of the wheels 46 engage the stop members 74. At this time, the two rear straps 56 and the two front straps 62 are engaged and adjusted thereby securely locking the wheelchair 14 fixedly in relation to the frame 16.

The occupant 12 of the wheelchair 14 is retained in position on the wheelchair 14 by a lap belt 78 that extends across the lap of the occupant and is connected to eye bolts 80 anchored to and extending above the rear side frame member 40 as illustrated in FIGS. 1 and 3 with the lap belt 78 being in the form of a flexible strap having a detachable buckle 81 with an adjustment feature incorporated therein in the manner of a conventional seat belt structure which includes a detachable connection as well as an adjustable connection to enable the lap belt 78 to be connected across the front of the lap portion of the wheelchair occupant 12 in a conventional manner and adjustable as to length to securely retain the occupant 12 in the wheelchair 14 when performing exercise routines.

The weight stack assembly 34 includes a pair of parallel rods 82 rigidly interconnected at their upper ends by a connecting bar 84 and rigidly interconnected at their lower ends by a connecting bar 86 which has a hinge rod 88 attached to the undersurface thereof and projecting outwardly beyond the ends of the connecting bar 86 and being pivotally connected to lugs 90 rigidly affixed to the upper surface of the intermediate end frame member 30 as illustrated in FIGS. 1 and 3.

Mounted on the pair of rods 82 is a plurality of generally rectangular weights 92 and 94 with the weights 94 being smaller in size and weight as compared to the weights 92. All of the weights are generally rectangular in configuration and include a lateral recess 96 communicating with the longitudinal edge thereof which faces the wheelchair. Each of the weights includes a pair of apertures 98 which receive the guide rods or tubes 82. Also, each of the weights includes a centrally disposed aperture 100 which receives a lift rod or tube 102 therethrough. The lift rod or tube includes a U-shaped yoke 104 secured to the upper end thereof by a retaining nut 106. An upper plate 108 engages the uppermost weight 94 and is secured adjustably but fixedly to the lift rod 102 by a set screw 110. The bar 106 includes short sleeves 112 which are rigid therewith with the outermost sleeves 112 receiving the guide rods or tubes 82 and the central sleeve 112 extends between the bar 108 and the U-shaped member 104.

A lock member 114 is slidably received in the recesses 96 in the weights 92 and 94 and is provided with a knob-like handle 116 which is accessible to the wheelchair occupant 12. The locking member 114 is in the form of a rod which can be inserted through a selected aperture 118 in the lift rod 102 thus enabling a selected number of weights to be lifted with the lift rod 102 with the remainder of the weight 92 and/or 94 remaining in supported relation on a flange 120 rigid with the guide rods 82. The lift rod 102 is slidably received in the apertures 100 in those weights below lock member 114.

The weight stack assembly 34 is actuated by a pivotal linkage mechanism generally designated by reference numeral 12 which includes a tubular member 124 extending between the lugs of the U-shaped bracket 104 and pivotally connected thereto by a pivot bolt or pin 125. The tubular member 124 is connected to a pair of diverging tubular members 126 which are rigidly connected to a pair of levers 128 which extend beyond the members 126 and have their forward ends pivotally connected to a pair of brackets 130 by a pivot pin or bolt 132 with the brackets 130 being secured to the upper ends of the intermediate vertical frame members by fastening bolts 134. The opposite ends of the levers 128 include a sleeve 136 perpendicular to the levers 128 with the sleeves 136 each slidably and adjustably receiving a bar 138 having a plurality of longitudinally spaced apertures 140 therein with a fastening pin or bolt 142 extending through the sleeve 136 and one of the apertures 140 thus longitudinally adjusting the bar 140 with respect to the sleeve 136. The lower end of each bar 138 includes an elongated handle 144 that is rigid with and perpendicular to the member 138 and forms a handle to be grasped by the hand 146 of the wheelchair occupant 12. By exerting downward force on the handles 144, the levers 128 will pivot about pivot pins or bolts 132. Downward movement of the handles 144 about the pivot axis defined by the pivot bolts 132 will cause the members 126 to swing upwardly in an arcuate path thereby lifting the weights 94 and 92 which are connected to the lift rod 102 with the guide rods 82 pivoting about hinge rod 88 during the arcuate swinging movement of the pivot bolt or pin 125 which connects the yoke 104 with the member 124. The handles 144 may be provided with handgrips or other devices to facilitate gripping engagement therewith to enable comfortable use of the exercise device. Optionally, the device may be constructed to provide a single handle or a dual handle assembly as illustrated and a single weight stack may be provided as illustrated or, if desired, two weight stacks can be provided to provide more flexibility in selecting the desired operational characteristics of the exercise device.

Figure 6:
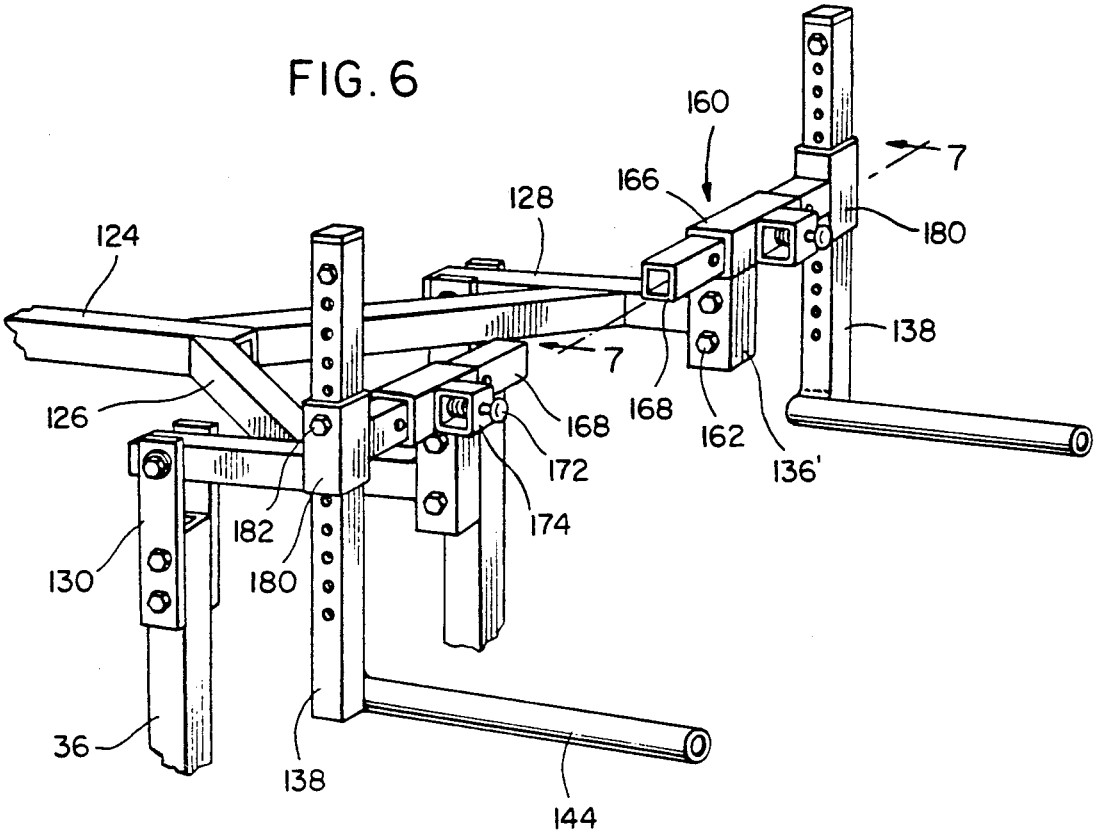
FIG. 6 is a fragmental perspective view of an adjustable embodiment of the invention.
Figure 7:
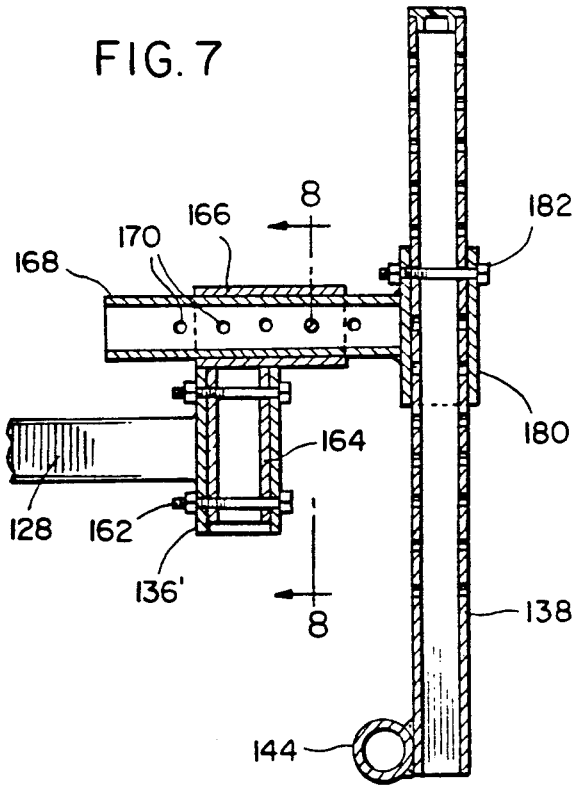
FIG. 7 is a sectional view taken along section line 7—7 on FIG. 6.
Figure 8:
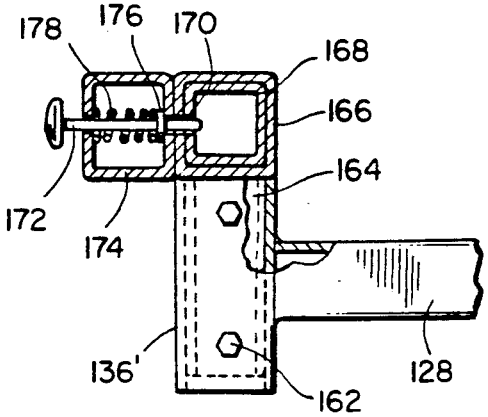
FIG. 8 is a sectional view taken along section line 8—8 on FIG. 7.

The shape and configuration of the linkage components may be varied with the adjustment characteristics of the apertured bar 138 providing a variation in the vertical at-rest position of the handles 144 in relation to the wheelchair occupant with the apertured bar 138 also being capable of being inserted downwardly into the top of sleeve 136 to orient the handles 144 at higher elevations to facilitate exercise of additional muscle groups. An adjustable embodiment of the invention is illustrated in FIGS. 6–8 in which an adapter 160 is inserted vertically into each of the sleeves 136[1] and secured in place by a pin or pair of bolts 162. Each adapter 160 includes a depending member 164 telescoped into sleeve 136[1] and secured in place by bolts 162. The upper end of member 164 includes a generally horizontally disposed transverse sleeve 166 slidably receiving an adjustable member 168 having a plurality of longitudinally spaced apertures 170 therein receiving a spring biased locking pin 172. The locking pin 172 is retractably mounted in housing 174 and has a flange 176 thereon engaged by a spring 178 which biases the pin 172 into one of the apertures 170 in member 168 to selectively lock member 168 in adjusted relation in sleeve 166. The end of member 168 includes a generally vertically disposed sleeve 180 which parallels sleeve 1361 and slidably receives apertured bar 138 having handle 144 thereon with a pin or bolt 182 securing the bar 138 in vertically adjusted position.

This structure, in effect, provides an additional adjustment of the at-rest position of the handles 144 and adapts the exercise device to different requirements of individual users by enabling the handles 144 to be moved inwardly and outwardly toward and away from each other and toward and away from the wheelchair to position the handles 144 in optimum relation to the hands 146 of the wheelchair occupant 12.

The adjustable member 168 may be inserted into sleeve 166 in either direction if desired to position the sleeve and apertured bar 138 outwardly of the sleeve 166 as shown or inwardly thereof to further increase the range of in and out adjustment of the handles. With this arrangement, the handles 144 can be adjusted inwardly and outwardly as well as up and down to enhance its effectiveness when used by various individuals following different exercise regimens.

The length of the hold-down straps and their relationship to the frame and wheelchair can be varied to enable the wheelchair to be securely locked to the frame when entering the frame forwardly as illustrated in FIG. 1 or in a reverse position (not shown). In each position, the large wheels of the wheelchair will engage the stop members 74 which can be adjusted longitudinal of the frame and the wheelchair handles or rear frame portions and the wheelchair forward frame portions will be anchored by the four downwardly diverging adjustable straps and the wheelchair occupant will be securely retained in position by the adjustable and separable seat belt. The frame can be anchored to the floor surface in any suitable manner and the device is relatively simple and can be used in the home, gymnasiums or similar areas and enables a wheelchair occupant to effectively exercise various muscle groups, especially those in the upper torso area.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An exercise device for wheelchair occupants comprising a rigid frame of generally U-shaped plan configuration and having a lateral open area to enable a wheelchair to be rolled into and out of the frame when facing in a forward or rearward direction, means on the frame to engage the wheelchair to secure the wheelchair securely to the frame, means connected with the frame to engage a wheelchair occupant to retain the occupant in the wheelchair, weight means mounted on the frame, means supporting the weight means from the frame to enable changes in vertical elevation of the weight means, and a pivotal linkage means connected to the weight means and the frame for raising and lowering the weight means, said linkage means including handle means positioned for grasping engagement by each hand of a wheelchair occupant to enable the wheelchair occupant to raise and lower the weight means, said means anchoring the wheelchair in the frame including a rigid, laterally extending stop member on each side of the frame, means adjustably mounting each stop member on the frame for lateral movement into the path of movement of large wheels on a wheelchair and adjustable, flexible strap means connecting the wheelchair to the frame at a plurality of points with the straps extending downwardly and outwardly in a diverging relation from the wheelchair and stop member to the frame, said means retaining the wheelchair occupant in the wheelchair including a flexible seat belt anchored to the frame and extending over the lap area of the user.

2. The exercise device as defined in claim 1 wherein said linkage means includes an elongated lever means, means pivoting an intermediate portion of the lever means to the frame for pivotal movement about an axis intermediate the weight means and handle means and means adjustably connecting the handle means with the lever means to enable variation of the relationship between the handle means and lever means.

3. The exercise device as defined in claim 2 wherein said lever means includes a pair of laterally spaced levers, a generally vertical sleeve at the end of each lever remote from the weight means with the sleeves being perpendicular to the levers, said means adjustably connecting the handle means and lever means including an apertured bar slidably and adjustably received in said each sleeve, and means locking the bar adjustably in the sleeve, said handle means including a handle rigidly associated with one end of each bar and projecting laterally thereof to provide a gripping handle for operating the linkage assembly with the elevational position of the handle being adjustable.

4. The exercise device as defined in claim 3 wherein said weight means includes a stack of weight bars, a pair of elongated guide rods extending through the weight bars to guide them during movement, the lower ends of the guide rods being pivotally connected to said frame to guide the weight bars during their movement.

5. The exercise device as defined in claim 4 wherein said weight bars include a plurality of heavier weight bars and a plurality of lighter weight bars, the forward end of said lever means of the linkage means being pivotally connected to a lift rod extending through said weight bars and means connecting selective of said weight bars to said lift rod to vary the weight being lifted by the lever means.

6. The exercise device as defined in claim 1 wherein an adapter interconnects the handle means and linkage means to enable the handle means to be adjusted horizontally for optimum positioning of the handle means in relation to the wheelchair occupant.

7. The exercise device as defined in claim 6 wherein said adapter includes a horizontally disposed sleeve, a horizontal support bar slidable in said sleeve, said support bar having a plurality of spaced apertures therein, and a spring biased pin on said sleeve to lock the support bar in adjusted position.

8. The exercise device as defined in claim 3 wherein each lever includes an adapter between the generally vertical sleeve and the end of the lever, said adapter including a generally horizontal sleeve mounted rigidly and laterally on the end of the lever, a generally horizontal, laterally extending support bar rigidly connected to said vertical sleeve, said support bar being slidably received in said horizontal sleeve, and means adjustably locking said support bar in relation to said horizontal sleeve to enable the gripping handles to be positioned in optimum lateral relation to a wheelchair occupant.

9. An exercise device for wheelchair occupants comprising a rigid frame of generally U-shaped plan configuration and having a lateral open area to enable a wheelchair to be rolled into and out of the frame when facing in a forward or rearward direction, means on the frame to engage the wheelchair to secure the wheelchair securely to the frame, means connected with the frame to engage a wheelchair occupant to retain the occupant in the wheelchair, weight means mounted on the frame, means supporting the weight means from the frame to enable changes in vertical elevation of the weight means, and a pivotal linkage means connected to the weight means and the frame for raising and lowering the weight means, said linkage means including handle means positioned for grasping engagement by each hand of a wheelchair occupant to enable the wheelchair occupant to raise and lower the weight means, said lever means including a pair of laterally spaced levers, a generally vertical sleeve at the end of each lever remote from the weight means with the sleeves being perpendicular to the levers, said means adjustably connection the handle means and lever means including an apertured bar slidably and adjustably received in said each sleeve, and means locking the bar adjustably in the sleeve, said handle means including a handle rigidly associated with one end of each bar and projecting laterally thereof to provide a gripping handle for operating the linkage assembly with the elevational position of the handle being adjustable, each lever including an adapter between the generally vertical sleeve and the end of the lever, said adapter including a generally horizontal sleeve mounted rigidly and laterally on the end of the lever, a generally horizontal, laterally extending support bar rigidly connected to said vertical sleeve, said support bar being slidably received in said horizontal sleeve, and means adjustably locking said support bar in relation to said horizontal sleeve to enable the gripping handles to be positioned in optimum lateral relation to a wheelchair occupant.

* * * * *